US008018451B2

(12) United States Patent
Park

(10) Patent No.: US 8,018,451 B2
(45) Date of Patent: Sep. 13, 2011

(54) LIQUID CRYSTAL DISPLAY

(75) Inventor: Jong-kook Park, Cheonan-si (KR)

(73) Assignee: Samsung Electronics Co., Ltd. (KR)

( * ) Notice: Subject to any disclaimer, the term of this patent is extended or adjusted under 35 U.S.C. 154(b) by 769 days.

(21) Appl. No.: 11/938,118

(22) Filed: Nov. 9, 2007

(65) Prior Publication Data

US 2008/0122829 A1 May 29, 2008

(30) Foreign Application Priority Data

Nov. 28, 2006 (KR) ..... 10-2006-0118529

(51) Int. Cl.
*G09G 5/00* (2006.01)

(52) U.S. Cl. ..... 345/213; 345/211; 345/100; 345/101

(58) Field of Classification Search ..... 345/38, 345/84–107, 204–215
See application file for complete search history.

(56) References Cited

U.S. PATENT DOCUMENTS

| | | | | |
|---|---|---|---|---|
| 5,896,117 | A | 4/1999 | Moon | |
| 7,296,247 | B1 * | 11/2007 | Hart | 716/2 |
| 7,330,002 | B2 * | 2/2008 | Joung, II | 315/309 |
| 7,786,966 | B2 * | 8/2010 | Nakanishi et al. | 345/89 |
| 2003/0122765 | A1 * | 7/2003 | Yoon | 345/94 |
| 2004/0207329 | A1 * | 10/2004 | Kudo et al. | 315/167 |
| 2006/0289893 | A1 * | 12/2006 | Lee et al. | 257/147 |
| 2007/0040795 | A1 * | 2/2007 | Lee et al. | 345/100 |
| 2007/0120794 | A1 * | 5/2007 | Shin et al. | 345/89 |
| 2007/0126684 | A1 * | 6/2007 | Chang et al. | 345/94 |
| 2008/0054987 | A1 * | 3/2008 | Choi et al. | 327/512 |
| 2008/0079701 | A1 * | 4/2008 | Shin et al. | 345/204 |
| 2009/0102779 | A1 * | 4/2009 | Jo | 345/101 |
| 2010/0053054 | A1 * | 3/2010 | Jeong et al. | 345/92 |

FOREIGN PATENT DOCUMENTS

| | | |
|---|---|---|
| CN | 1658270 A | 8/2005 |
| CN | 1728205 A | 2/2006 |
| KR | 1020050083003 | 8/2005 |

* cited by examiner

*Primary Examiner* — Amare Mengistu
*Assistant Examiner* — Dmitriy Bolotin
(74) *Attorney, Agent, or Firm* — Innovation Counsel LLP

(57) ABSTRACT

A liquid crystal display (LCD) capable of enhancing display quality includes a voltage generation unit, a clock generation unit, a gate driving unit, and a display unit. The voltage generation unit outputs a gate-on voltage and first and second gate-off voltages that are different from each other. The clock generation unit outputs a first clock signal and a second clock signal whose phase is opposite to the phase of the first clock signal. The first clock signal swings between the gate-on voltage and the first gate-off voltage. The gate driving unit is provided with the first clock signal, the second clock signal, and the second gate-off voltage and outputs a gate signal. The display unit includes a plurality of pixels that are turned on or off in response to the gate signal and that display an image.

17 Claims, 10 Drawing Sheets

LIQUID CRYSTAL DISPLAY

CROSS-REFERENCE TO RELATED APPLICATION

This application claims priority from Korean Patent Application No. 10-2006-0118529 filed on Nov. 28, 2006 in the Korean Intellectual Property Office, the disclosure of which is incorporated herein by reference in its entirety.

BACKGROUND OF THE INVENTION

1. Field of the Invention

The present invention relates to a liquid crystal display (LCD) having an enhanced display quality.

2. Description of the Related Art

Liquid crystal displays (LCDs) include a liquid crystal panel equipped with a plurality of gate lines and a plurality of data lines, a gate driving unit which outputs a gate signal to the gate lines, and a data driving unit which outputs a data signal to the data lines. In order to reduce the size and enhance the manufacturability of LCDs, gate drivers are integrated in a peripheral area of the LCD panel. A gate driving unit is formed on the LCD panel that includes a plurality of stages for sequentially outputting gate signals. Each of the stages includes at least one amorphous silicon thin film transistor (a-Si TFT). The a-Si TFT receives first and second clock signals and outputs a gate signal. The driving capability of an a-Si TFT varies according to the ambient temperature, the driving capability of an a-Si TFT decreasing with ambient temperature.

When the temperature is very low, an a-Si TFT may not be able to output a gate signal having a sufficient voltage to turn on or off the switching device for a pixel. Therefore, in order to enhance the driving capability of the a-Si TFT at low temperatures, the amplitudes of the first and second clock signals are increased. Given that the first and second clock signals swing between a gate-on voltage and a gate-off voltage, the gate-off voltage is reduced in order to increase the amplitudes of the first and second clock signals.

Conventionally, a decrease in a gate-off voltage causes an image sticking, thereby adversely affecting display quality. Therefore, it is necessary to enhance the driving capability of an a-Si TFT at low temperatures and decrease the after-image.

SUMMARY OF THE INVENTION

According to an aspect of the present invention, there is provided an LCD that has an enhanced quality of display that includes a voltage generation unit, a clock generation unit, a gate driving unit, and a display unit. The voltage generation unit outputs a gate-on voltage and first and second gate-off voltages. The first and second gate-off voltages are different from each other. The clock generation unit outputs a first clock signal and a second clock signal whose phase is opposite to the phase of the first clock signal. The first clock signal swings between the gate-on voltage and the first gate-off voltage. The gate driving unit is provided with the first clock signal, the second clock signal, and the second gate-off voltage and outputs a gate signal. The display unit includes a plurality of pixels that are turned on or off in response to the gate signal and that display an image.

According to another aspect of the present invention, there is provided an LCD including a voltage generation unit, a signal control unit, a clock generation unit, a gate driving unit, and a display unit. The voltage generation unit comprises a temperature sensor that outputs a temperature-variable voltage which varies according to the ambient temperature. A boost converter generates a driving voltage and a pulse signal by boosting a first input voltage which varies according to the temperature-variable voltage and outputs the driving voltage and the pulse signal.

A gate-on voltage generator generates the gate-on voltage by shifting the driving voltage by an amount corresponding to the voltage of the pulse signal and outputs the gate-on voltage. A first gate-off voltage generator generates the first gate-off voltage by shifting the second input voltage by an amount corresponding to the voltage of the pulse signal and outputs the first gate-off voltage. A second gate-off voltage generator receives the first gate-off voltage, generates the second gate-off voltage by dividing the first gate-off voltage and outputs the second gate-off voltage. The signal control unit provides a scanning start signal.

The clock generation unit outputs a first clock signal and a second clock signal whose phase is opposite to the phase of the first clock signal, the first clock signal swinging between the gate-on voltage and the first gate-off voltage. The gate driving unit is enabled by the scanning start signal, is provided with the first clock signal and the second clock signal and outputs a gate signal that swings between the gate-on voltage and the second gate-off voltage. The display unit comprises a plurality of pixels that are turned on or off in response to the gate signal and that display an image.

BRIEF DESCRIPTION OF THE DRAWINGS

The above and other features and advantages of the present invention will become more apparent by describing in detail preferred embodiments thereof with reference to the attached drawings, in which.

DETAILED DESCRIPTION

Figure 1:
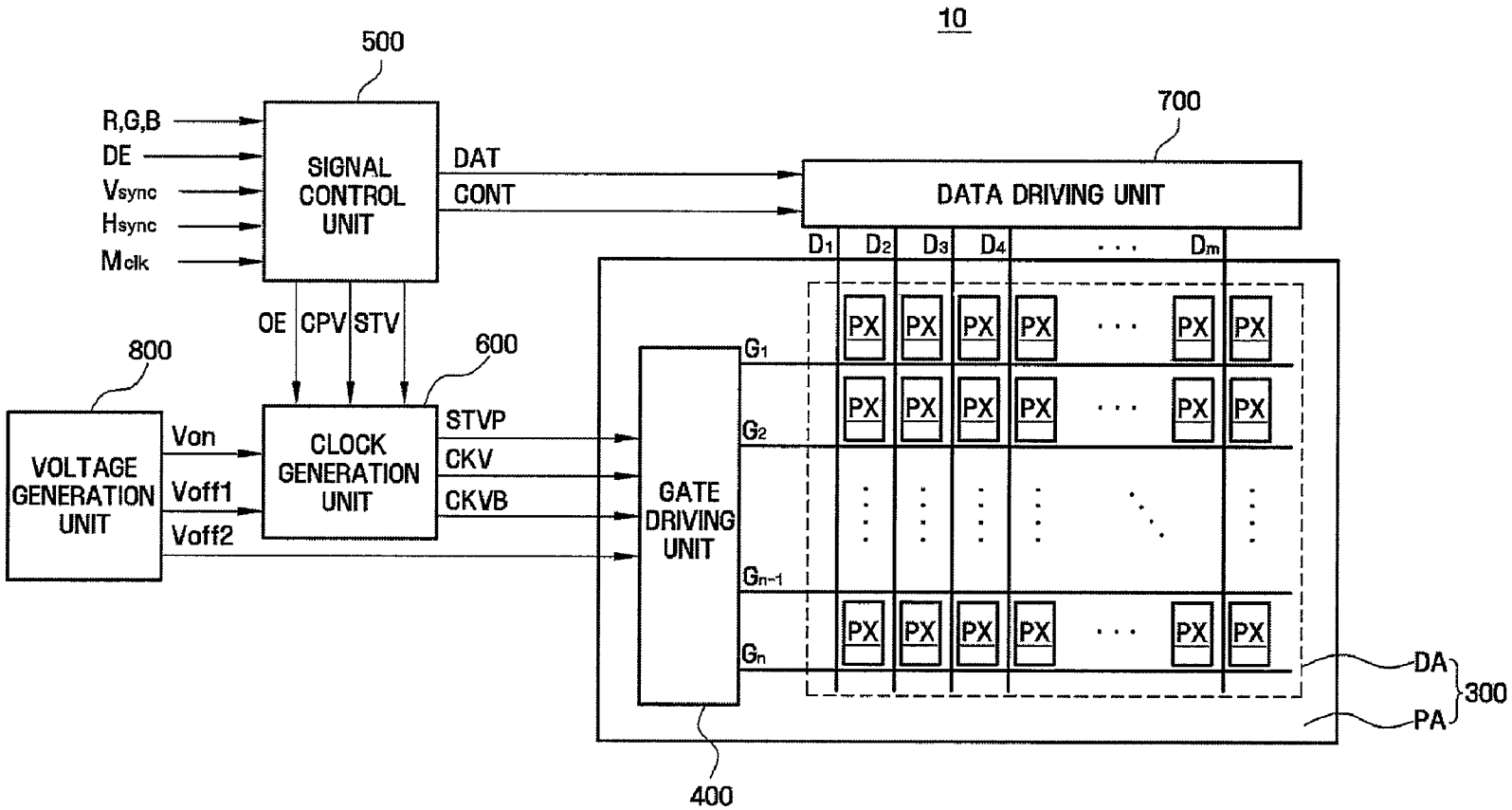
FIG. 1 is a block diagram of a liquid crystal display according to an embodiment of the present invention.
Figure 2:
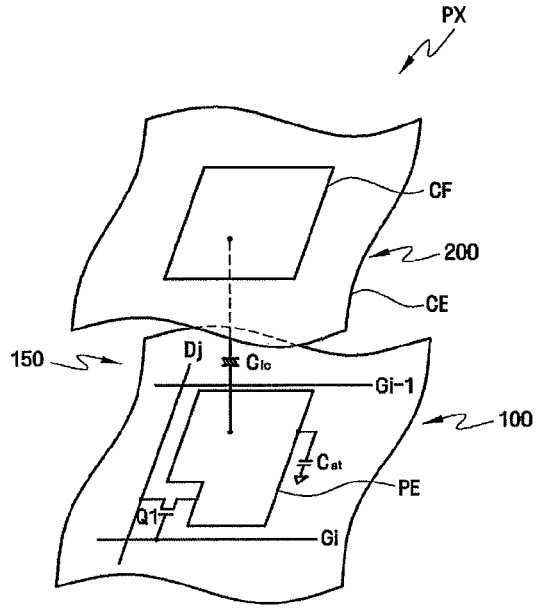
FIG. 2 is an equivalent circuit diagram of a pixel illustrated in FIG. 1.
Figure 3:
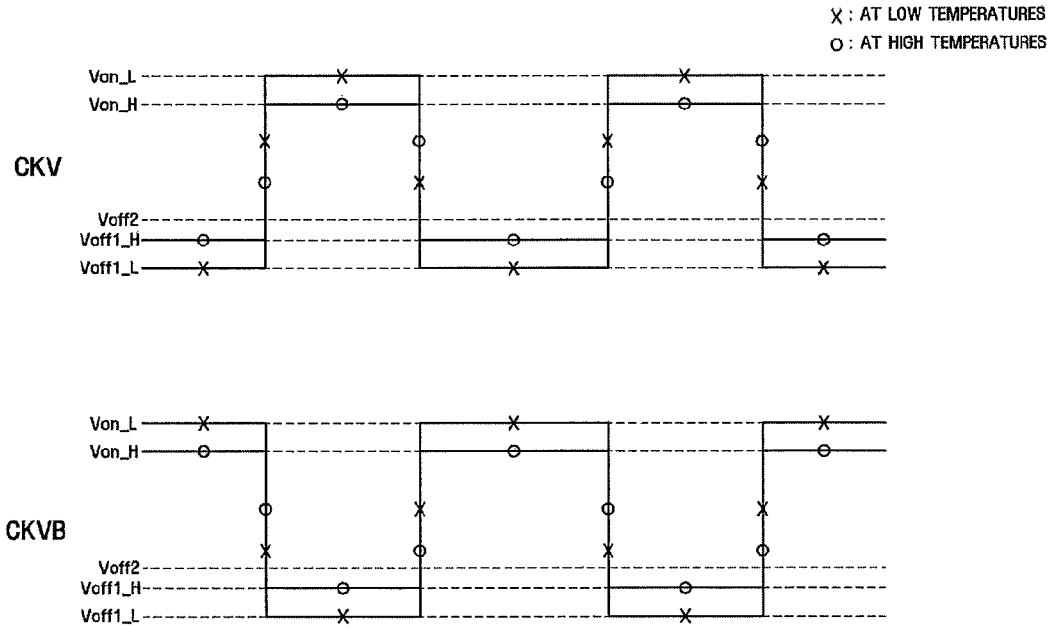
FIG. 3 is a signal diagram for explaining the operation of a clock generation unit illustrated in FIG. 1.
Figure 4:
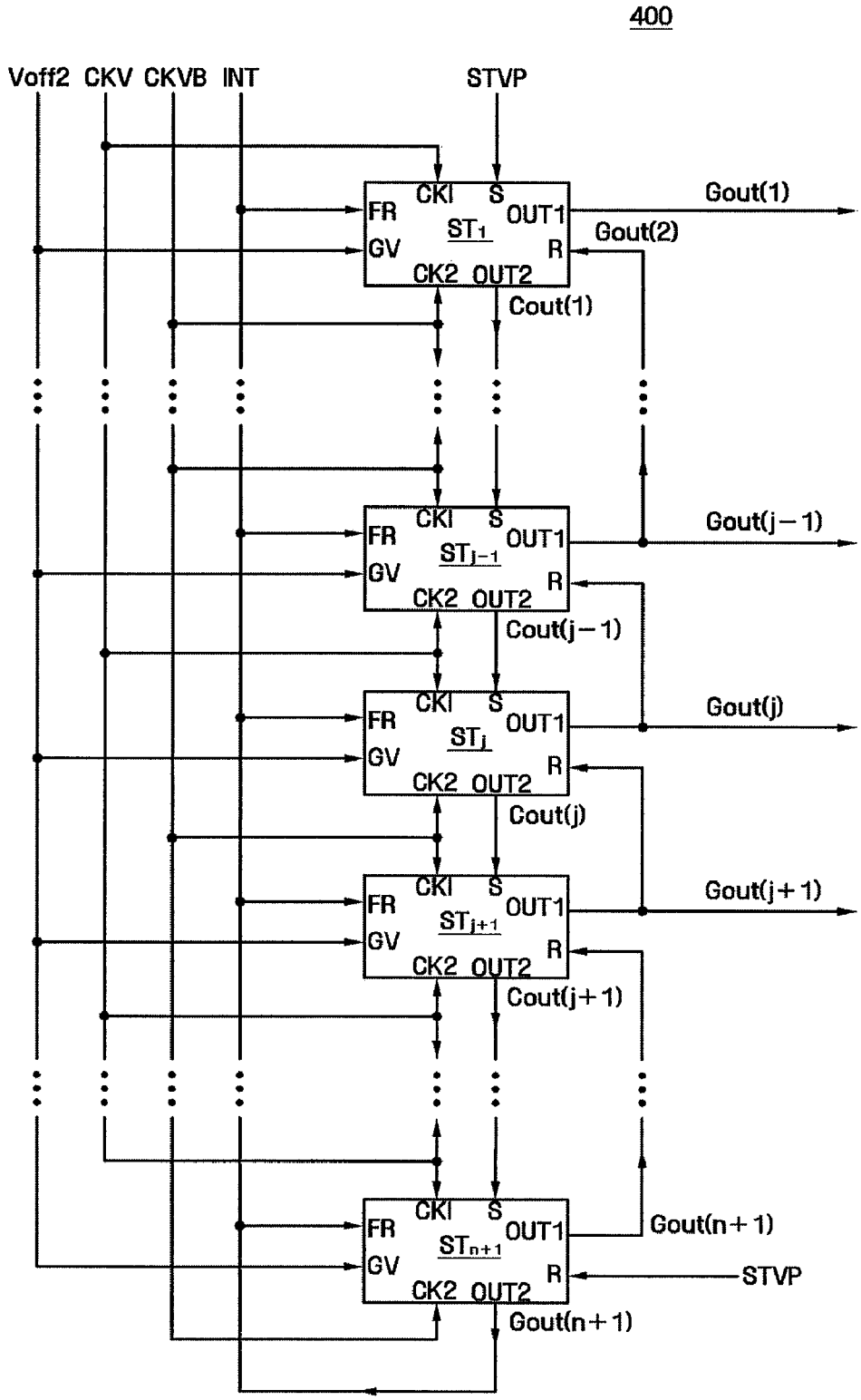
FIG. 4 is a block diagram of a gate driving unit illustrated in FIG. 1.
Figure 5:
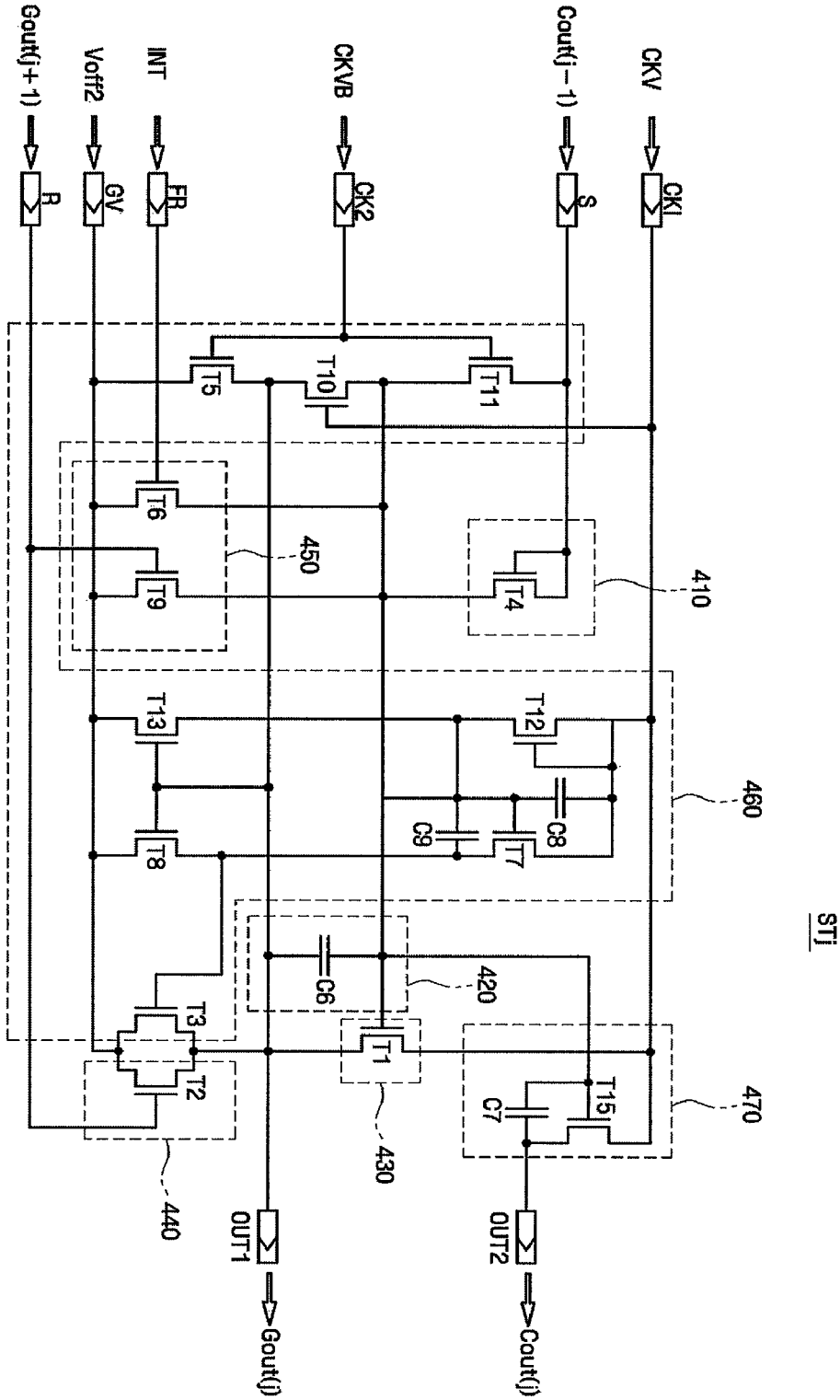
FIG. 5 is a circuit diagram for explaining a j-th stage illustrated in FIG. 4.
Figure 6:
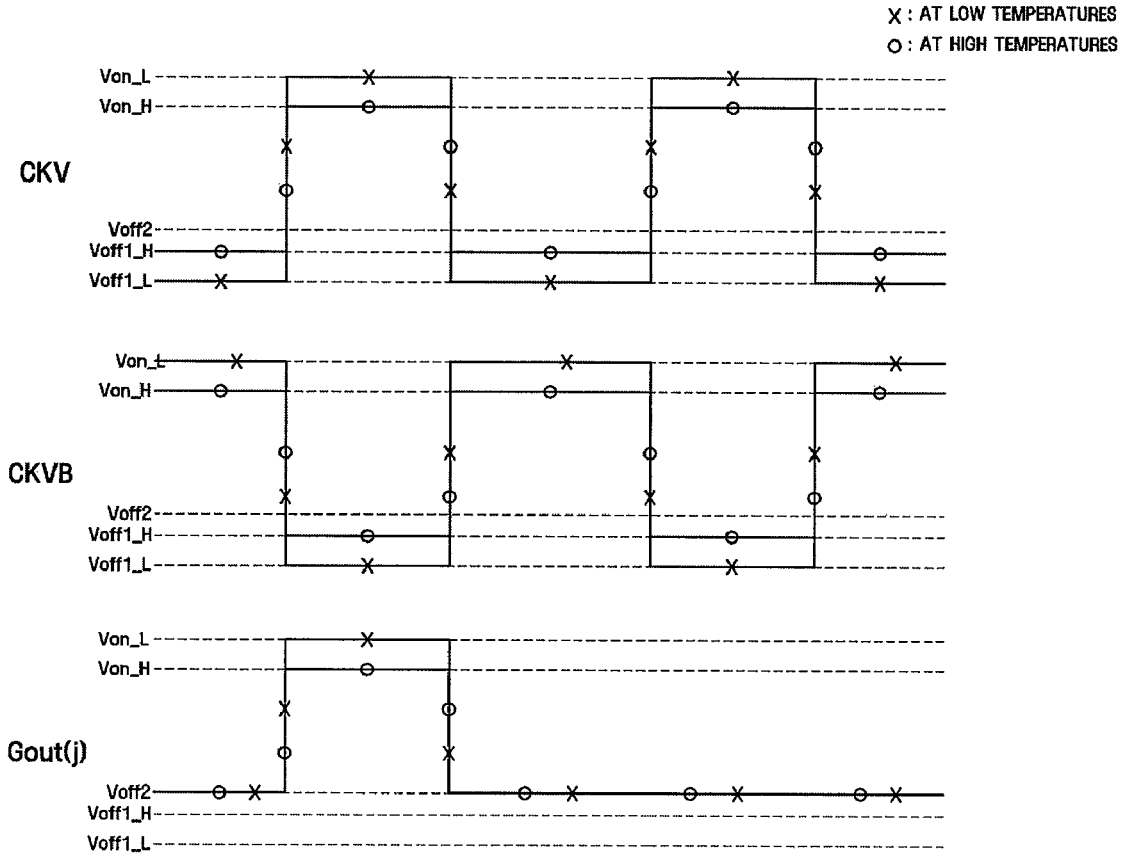
FIG. 6 is a signal diagram for explaining the j-th stage illustrated in FIG. 5.

FIG. 1 is a block diagram of a liquid crystal display according to an embodiment of the present invention, FIG. 2 is an equivalent circuit diagram of a pixel illustrated in FIG. 1, FIG. 3 is a signal diagram for explaining the operation of a clock generation unit illustrated in FIG. 1, FIG. 4 is a block diagram of a gate driving unit illustrated in FIG. 1, FIG. 5 is a circuit diagram for explaining a j-th stage illustrated in FIG. 4, and FIG. 6 is a signal diagram for explaining the j-th stage illustrated in FIG. 5.

Referring to FIG. 1, a liquid crystal display (LCD) 10 according to an embodiment of the present invention includes a liquid crystal panel 300, a voltage generation unit 800, a signal control unit 500, a clock generation unit 600, a gate driving unit 400, and a data driving unit 700.

The liquid crystal panel 300 is divided into a display area DA where images are displayed and a non-display area PA.

The display area DA includes a plurality of gate lines $G_1$ through $G_n$, a plurality of data lines $D_1$ through $D_m$, and a plurality of pixels PX which are respectively formed at the interconnections between the gate lines $G_1$ through $G_n$ and the data lines $D_1$ through $D_m$ and display images. The gate lines $G_1$ through $G_n$ extend in a row direction and are parallel or essentially parallel to one another. The data lines $D_1$ through $D_m$ extend in a column direction and are parallel or essentially parallel to one another.

The structure of each of the pixels PX illustrated in FIG. 1 will hereinafter be described in detail with reference to FIG. 2.

Referring to FIG. 2, a pixel electrode PE is formed on a first substrate 100, and a common electrode CE and a color filter CF are formed on a second substrate 200. A liquid crystal layer 150 is interposed between the first substrate 100 and the second substrate 200. For example, a pixel PX which is connected to an i-th gate line $G_i$ (i=1~n) and a j-th data line $D_j$ (j=1~m) includes a switching device Q1 which is connected to the i-th gate line $G_i$ and the j-th data line $D_j$, a liquid crystal capacitor $C_{lc}$ which is connected to the switching device Q1, and a storage capacitor $C_{st}$. The storage capacitor $C_{st}$ may not be provided if not necessary.

The first substrate 100 is much larger than the second substrate 200. The non-display area PA illustrated in FIG. 1 corresponds to the area of the first substrate 100 not overlapped by the second substrate 200, and thus, no image is displayed in the non-display area PA.

Referring to FIG. 1, the voltage generation unit 800 generates voltages that are needed for the operation of the LCD 10, for example, a gate-on voltage Von, a first gate-off voltage Voff1, and a second gate-off voltage Voff2.

The voltage generation unit 800 provides the gate-on voltage Von and the first gate-off voltage Voff1 to the clock generation unit 600 and provides the second gate-off voltage Voff2 to the gate driving unit 400. The gate-on voltage Von and/or the first gate-off voltage Voff1 may vary according to the ambient temperature. The second gate-off voltage Voff2 may be higher than the first gate-off voltage Voff1. For example, the gate-on voltage Von may increase at low temperatures and decrease at high temperatures. The first gate-off voltage Voff1 may decrease at low temperatures and increase at high temperatures. Alternatively, the first gate-off voltage Voff1 may be maintained at a uniform level regardless of the ambient temperature. The operation and structure of the voltage generation unit 800 will be described later in further detail with reference to FIG. 6.

The signal control unit 500 receives from an external graphic controller (not shown) an input image signal (R, G, B) and an input control signal that control the display of the input image signal (R, G, B). Examples of the input control signal include a vertical synchronization signal $V_{sync}$, a horizontal synchronization signal $H_{sync}$, a main clock signal $M_{clk}$, and a data enable signal DE.

The signal control unit 500 generates a data control signal CONT based on the input image signal (R, G, B) and the input control signal, and transmits the data control signal CONT and image data DAT to the data driving unit 700.

Also, the signal control unit 500 provides the clock generation unit 600 with a first clock generation control signal OE, a second clock generation control signal CPV, and a original scanning start signal STV. The first clock generation control signal OE is a gate enable signal that enables a gate signal. The original scanning start signal STV is a signal indicating the beginning of a frame. The second clock generation control signal CPV may be a gate clock signal that determines the duty ratio of a gate signal.

The clock generation unit 600 generates a first clock signal CKV and a second clock signal CKVB based on the gate-on voltage Von and the first gate-off voltage Voff1 and outputs the first clock signal CKV and the second clock signal CKVB in response to the first clock generation control signal OE, the second clock generation control signal CPV, and the original scanning start signal STV. Also, the clock generation unit 600 converts the original scanning start signal STV into a scanning start signal STVP and provides the scanning start signal STVP to the gate driving unit 400. The scanning start signal STVP is a signal obtained by increasing the amplitude of the original scanning start signal STV.

The first clock signal CKV and the second clock signal CKVB swing between the gate-on voltage Von and the first gate-off voltage Voff1 and have opposite phases. The first clock signal CKV and the second clock signal CKVB will hereinafter be described in further detail with reference to FIGS. 1 and 3.

The voltage generation unit 800 may output a gate-on voltage Von_L at low temperatures and output a gate-on voltage Von_H at high temperatures, as described above. Also, the voltage generation unit 800 may output a first gate-off voltage Voff1_L at low temperatures and output a first gate-off voltage Voff1_H at high temperatures.

Therefore, the clock generation unit 600 may output a first clock signal CKV and a second clock signal CKVB that swing between the gate-on voltage Von_H and the first gate-off voltage Voff1_H at high temperatures. Also, the clock generation unit 600 may output a first clock signal CKV and a second clock signal CKVB that swing between the gate-on voltage Von_L and the first gate-off voltage Voff1_L at low temperatures. The operation and structure of the clock generation unit 600 will be described later in further detail with reference to FIGS. 11 and 12.

The data driving unit 700 is provided with the image data DAT signal and the data control signal CONT by, for example, the signal control unit 500. The data driving unit 700 provides an image data voltage corresponding to the image data DAT to each of the data lines $D_1$ through $D_m$. The data control signal CONT includes a horizontal start signal that initiates the operation of the data driving unit 700 and a load signal for controlling the output of two data voltages.

The gate driving unit 400 is provided with the first clock signal CKV, the second clock signal CKVB, the scanning start signal STVP, and the second gate-off voltage Voff2, and provides a gate signal to each of the gate lines $G_1$ through $G_n$.

The gate driving unit 400 will hereinafter be described in further detail with reference to FIGS. 4 through 6. FIGS. 4 and 5 illustrate an example of the gate driving unit 400 but it is intended that the present invention not be restricted thereto.

The gate driving unit 400 may include at least one amorphous silicon thin film transistor (a-Si TFT).

The gate driving unit 400 includes a plurality of stages $ST_1$ through $ST_{n+1}$. The stages $ST_1$ through $ST_{n+1}$ are connected in cascade, and respectively output a plurality of gate signals $Gout_{(1)}$ through $Gout_{(n+1)}$. The second gate-off voltage Voff2, the first clock signal CKV and the second clock signal CKVB illustrated in FIG. 3 are input to each of the stages $ST_1$ through $ST_{n+1}$. All the stages $ST_1$ through $ST_{n+1}$ except for the last stage $ST_{n+1}$ are connected to respective corresponding gate lines (not shown) of a liquid crystal panel (not shown).

The first clock signal CKV and the second clock signal CKVB are signals that swing between the gate-on voltage Von and the first gate-off voltage Voff1 and that have opposite phases, as described above. When the gate signals $Gout_{(1)}$ through $Gout_{(n+1)}$ are logic high, the first clock signal CKV or the second clock signal CKVB is output. When the gate signals $Gout_{(1)}$ through $Gout_{(n+1)}$ are logic low, the second gate-off voltage Voff2 is output. In other words, the gate signals $Gout_{(1)}$ through $Gout_{(n+1)}$ swing between the gate-on voltage Von and the second gate-off voltage Voff2.

Each of the stages $ST_1$ through $ST_{n+1}$ includes a first clock terminal CK1, a second clock terminal CK2, a set terminal S, a reset terminal R, a power supply voltage terminal GV, a frame reset terminal FR, a gate output terminal OUT1, and a carry output terminal OUT2.

For example, a carry signal $Cout_{(j-1)}$ of the (j−1)-th stage $ST_{j-1}$ is input to the set terminal S of the j-th stage $ST_j$; a gate signal $Gout_{(j+1)}$ of the (j+1)-th stage $ST_{j+1}$ is input to the reset terminal R of the j-th stage $ST_j$; the first clock signal CKV and the second clock signal CKVB are respectively input to the first clock terminal CK1 and the second clock terminal CK2 of the j-th stage $ST_j$; the second gate-off voltage Voff2 is input to the power supply voltage terminal GV of the j-th stage $ST_j$; and an initialization signal INT is input to the frame reset terminal FR of the j-th stage $ST_j$. The gate output terminals OUT1 respectively output the gate signals $Gout_{(1)}$ through $Gout_{(n+1)}$, and the carry output terminals OUT2 respectively output the carry signals $Cout_{(1)}$ through $Cout_{(n+1)}$. The carry signal $Cout_{(n+1)}$ of the last stage $ST_{n+1}$ is an initialization signal and is provided to each of the stages $ST_1$ through $ST_{n+1}$.

The first stage $ST_1$, unlike the second through (n+1)-th stages $ST_2$ through $ST_{n+1}$, is provided with the scanning start signal STVP instead of a carry signal of a previous stage; and the (n+1)-th and last stage $ST_{n+1}$, unlike the first through n-th stages $ST_1$ through $ST_n$, is provided with the scanning start signal STVP instead of a gate signal of a subsequent stage.

The j-th stage $ST_j$ illustrated in FIG. 4 will hereinafter be described in further detail with reference to FIGS. 5 and 6.

Referring to FIG. 5, the j-th stage $ST_j$ includes a buffer unit 410, a charge unit 420, a pull-up unit 430, a carry signal generation unit 470, a pull-down unit 440, a discharge unit 450, and a holding unit 460. The carry signal generation unit 470 may not be provided if not necessary. In this case, the gate signal $Gout_{(j)}$ may serve as a carry signal.

The buffer unit 410 provides a carry signal of a previous stage, which is commonly input to both the drain and gate of a transistor T4 via the set terminal S, i.e., the carry signal $Cout_{(j-1)}$ of the (j−1)-th stage $ST_{j-1}$, to the charge unit 420, the carry signal generation unit 470, the discharge unit 450, and the holding unit 460, which are connected to the source of the transistor T4.

The charge unit 420 includes a capacitor C6. A first end of the capacitor C6 is connected to the source of the transistor T4 and to the discharge unit 450 and a second end of the capacitor C6 is connected to the gate output terminal OUT1. The charge unit 420 is charged in response to the carry signal $Cout_{(j-1)}$ of the (j−1)-th stage $ST_{j-1}$.

The pull-up unit 430 includes a transistor T1. The drain of the transistor T1 is connected to the first clock terminal CK1, the gate of the transistor T1 is connected to the first end of the capacitor C6, the source of the transistor T1 is connected to the second end of the capacitor C6 and to the gate output terminal OUT1. Once the capacitor C6 of the charge unit 420 is charged, the transistor T1 is turned on and provides the first clock signal CKV, which is input thereto via the first clock terminal CK1, via the gate output terminal OUT1 as the gate signal $Gout_{(j)}$. If the first clock signal CKV is logic high, i.e., if the first clock signal CKV has the gate-on voltage Von_H or Von_L, the pull-up unit 430 outputs a gate signal $Gout_{(j)}$ having the gate-on voltage Von_H or Von_L.

The driving capability of the pull-up unit 430 deteriorates at low temperatures. However, since the first clock signal CKV and the second clock signal CKVB are signals that swing between the gate-on voltage Von_L and the first gate-off voltage Voff_L and have large amplitudes, the driving capability of the pull-up unit 430 can be prevented from considerably deteriorating even at low temperatures.

The carry signal generation unit 470 includes a transistor T15 and a capacitor C7 which is connected to the gate and source of the transistor T15. The drain of the transistor T15 is connected to the first clock terminal CK1, the source of the transistor T15 is connected to the carry output terminal OUT2, and the gate of the transistor T15 is connected to the charge unit 420. The capacitor C7 is charged with the same voltage as the charge unit 420. Once the capacitor C7 is charged, the transistor T15 outputs the first clock signal CKV via the carry output terminal OUT2 as the carry signal $Cout_{(j)}$.

The pull-down unit 440 includes a transistor T2. The drain of transistor T2 is connected to the source of transistor T1 and the second end of the capacitor C6, the source of transistor T2 is connected to the power supply voltage terminal GV, and the gate of transistor T2 is connected to the reset terminal R. The pull-down unit 440 is turned on by a gate signal of a subsequent stage input thereto via the reset terminal R, i.e., the gate signal $Gout_{(j+1)}$ of the (j+1)-th stage $ST_{j+1}$, and pulls down the voltage of the gate signal $Gout_{(j)}$ to the second gate-off voltage Voff2. The second gate-off voltage Voff2 may be higher than the first gate-off voltage Voff1.

The discharge unit 450 includes a transistor T9 and a transistor T6. The gate of the transistor T9 is connected to the reset terminal R, the drain of the transistor T9 is connected to the first end of the capacitor C6, and the source of the transistor T9 is connected to the power-supply voltage terminal GV. The transistor T9 discharges the charge unit 420 in response to the gate signal $Gout_{(j+1)}$ of the (j+1)-th stage $ST_{j+1}$. The gate of the transistor T6 is connected to the frame reset terminal FR, the drain of the transistor T6 is connected to the first end of the capacitor C6, and the source of the transistor T6 is connected to the power supply voltage terminal GV. The transistor T6 discharges the charge unit 420. That is to say, the discharge unit 450 discharges the capacitor C6 through the sources of the transistors T9 and T6 to the second gate-off voltage Voff2 in response to the gate signal $Gout_{(j+1)}$ of the (j+1)-th stage $ST_{j+1}$ or the start signal INT.

When the gate signal $Gout_{(j)}$ is logic high, the holding unit 460 performs a hold operation by maintaining a transistor T3 to be turned off. When the gate signal $Gout_{(j)}$ becomes logic low, the holding unit 460 performs a hold operation by turning on the transistor T3 and a transistor T5.

The drain of the transistor T3 is connected to the gate output terminal OUT1, and the second gate-off voltage Voff2 is applied to the source of the transistor T3. Transistors T7 and T8 are turned on when the gate signal $Gout_{(j)}$, which is output via the gate output terminal OUT1, is logic high. Then, the transistors T7 and T8 are turn off the transistor T3 by pulling down the voltage of the gate of the transistor T3 to the second gate-off voltage Voff2. As a result, the gate of the transistor T3 can be held to a logic high level of the gate signal $Gout_{(j)}$, i.e., the gate-on voltage Von_H or Von_L.

The drain of a transistor T11 is connected to the set terminal S, the gate of the transistor T11 is connected to the second clock terminal CK2, and the source of the transistor T11 is connected to the first end of the capacitor C6. The drain of a transistor T10 is connected to the source of the transistor T11 and to the first end of the capacitor C6, the gate of the transistor T10 is connected to the first clock terminal CK1, and the source of the transistor T10 is connected to the gate output terminal OUT1. The drain of the transistor T5 is connected to the gate output terminal OUT1, the gate of the transistor T5 and the gate of the transistor T11 are commonly connected to the second clock terminal CK2, and the source of the transistor T5 is connected to the power supply voltage terminal GV.

When the second clock signal CKVB is logic high, the gate signal $Gout_{(j)}$ is logic low and the transistor T5 is turned on. Then, the holding unit 460 performs a hold operation such that the gate output terminal OUT1 can be held to the second gate-off voltage Voff2.

In other words, since the amplitudes of the first clock signal CKV and the second clock signal CKVB increase even at low temperatures, the driving capability of the gate driving unit 400 can be prevented from considerably deteriorating. Therefore, it is possible to enhance display quality even at low temperatures by providing a gate signal $Gout_{(j)}$ whose current and voltage are sufficient to turn on or off a plurality of switching devises Q1 (e.g., the switching device Q1 illustrated in FIG. 2) that are connected to the gate lines $G_1$ through $G_n$.

The second gate-off voltage Voff2, which is provided to the gate lines $G_1$ through $G_n$, is different from the first clock signal CKV or the first gate-off voltage Voff1 that is a logic low level signal of the second clock signal CKVB. In other words, the second gate-off voltage Voff2 may be controlled independently of the first gate-off voltage Voff1. For example, if the first gate-off voltage Voff1, which is a low-temperature voltage, is provided to the gate lines $G_1$ through $G_n$, the switching devices Q1 may reduce a leakage current. As a result, a plurality of pixel electrodes PE (e.g., the pixel electrode PE illustrated in FIG. 2) may not be quickly discharged during the switching devices Q1 are turn off, thereby causing an image sticking.

However, according to the present embodiment, the second gate-off voltage Voff2, which is higher than the first gate-off voltage Voff1, is provided to the gate lines $G_1$ through $G_n$, a data voltage with which the pixel electrodes PE are charged can be quickly discharged after the power is cut off even at low temperatures, thereby decreasing an image sticking phenomenon.

Figure 7:
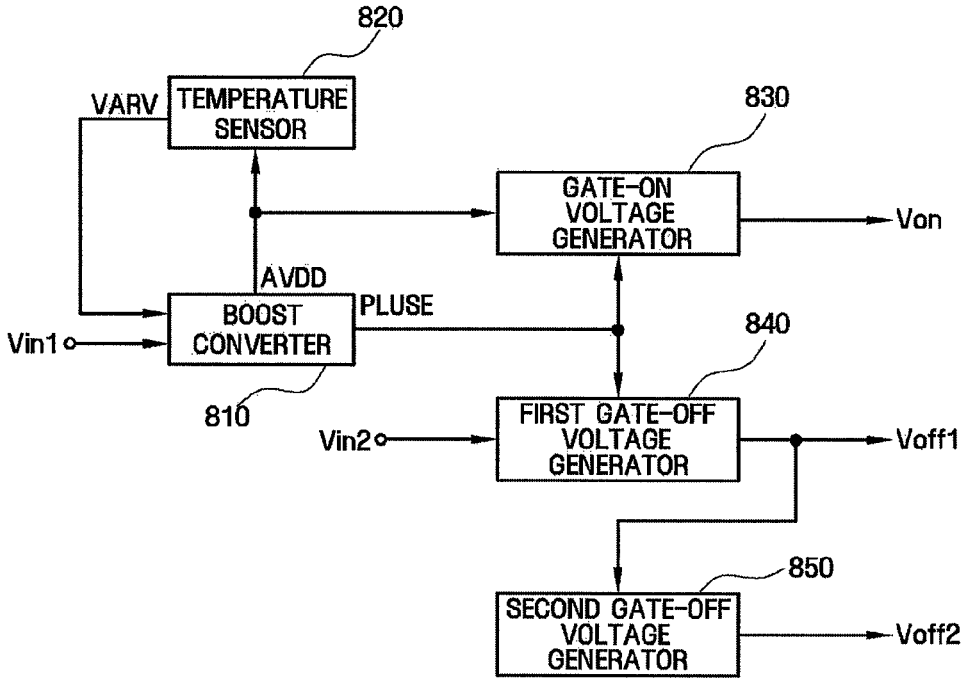
FIG. 7 is a block diagram of a voltage generation unit illustrated in FIG. 1.
Figure 8:
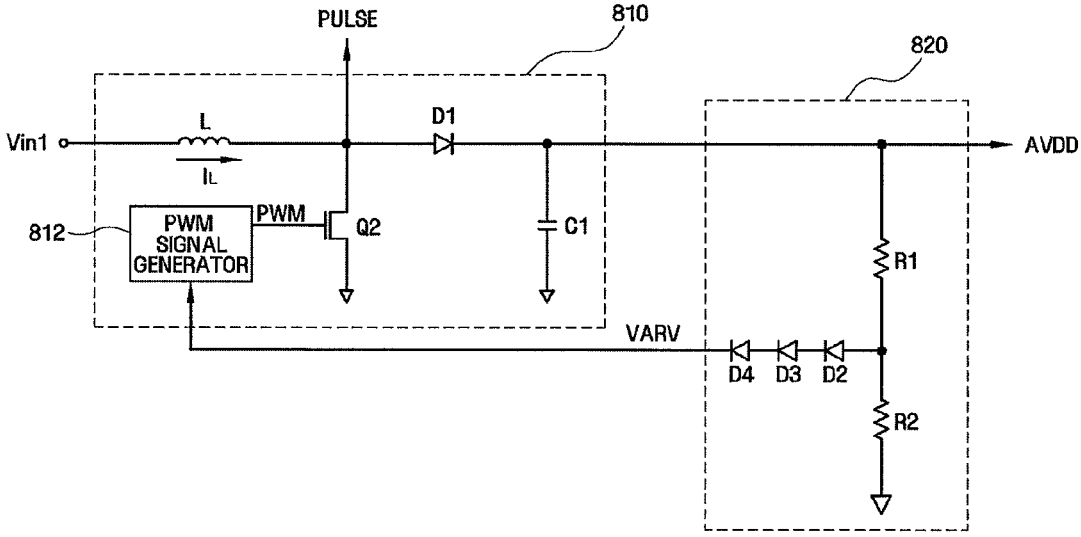
FIG. 8 is a circuit diagram of a boost converter illustrated in FIG. 7.
Figure 9:
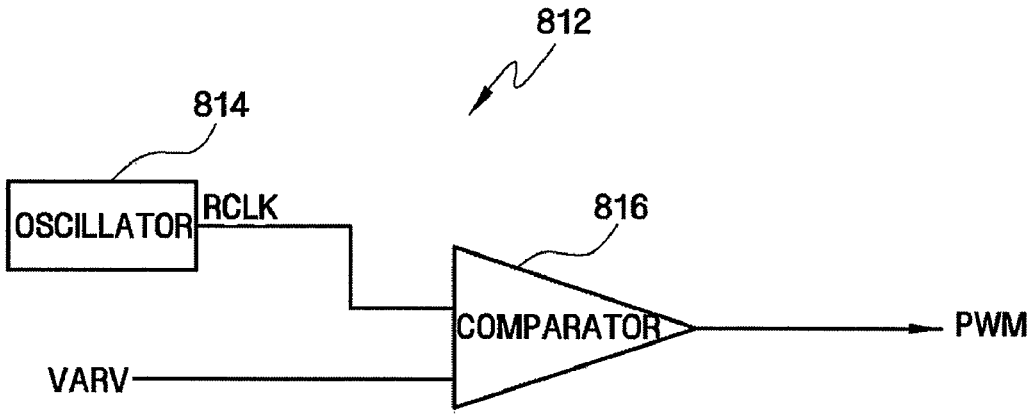
FIG. 9 is a block diagram of a pulse width modulation generator illustrated in FIG. 8.
Figure 10:
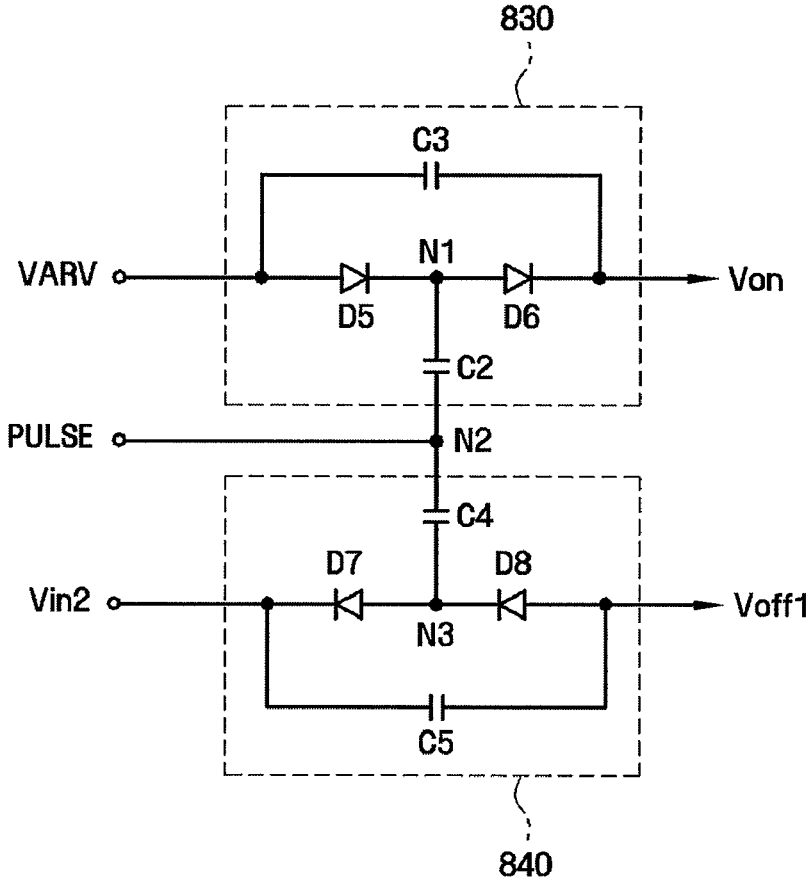
FIG. 10 is a circuit diagram of a gate-on voltage generation unit and a first gate-off voltage generation unit illustrated in FIG. 7.
Figure 11:
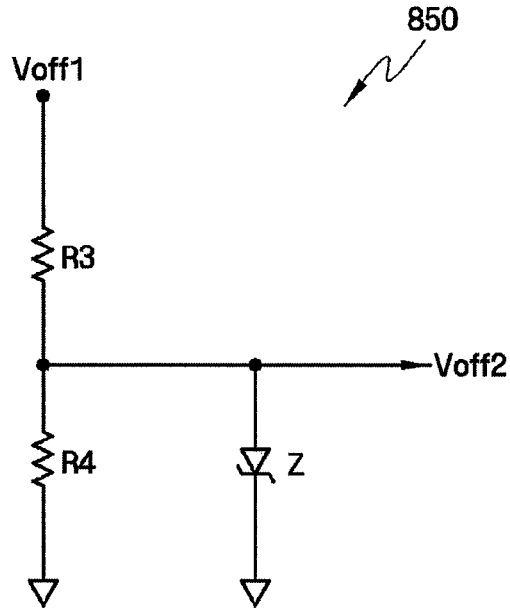
FIG. 11 is a circuit diagram of a second gate-off voltage generation unit illustrated in FIG. 7.

The structure and operation of the voltage generation unit 800 illustrated in FIG. 1 will hereinafter be described in further detail with reference to FIGS. 7 through 11. FIG. 7 is a block diagram of a voltage generation unit illustrated in FIG. 1, FIG. 8 is a circuit diagram of a boost converter illustrated in FIG. 7, FIG. 9 is a block diagram of a pulse width modulation generator illustrated in FIG. 8, FIG. 10 is a circuit diagram of a gate-on voltage generation unit and a first gate-off voltage generation unit illustrated in FIG. 7, and FIG. 11 is a circuit diagram of a second gate-off voltage generation unit illustrated in FIG. 7.

Referring to FIG. 7, the voltage generation unit 800 includes a boost converter 810, a temperature sensor 820, a gate-on voltage generator 830, a first gate-off voltage generator 840, and a second gate-off voltage generator 850.

The temperature sensor 820 outputs a temperature-variable voltage VARV which varies according to the ambient temperature. The boost converter 810 generates a driving voltage AVDD and a pulse signal PULSE by boosting a first input voltage Vin1. The driving voltage AVDD varies according to the temperature-variable voltage VARV. The gate-on voltage generator 830 shifts the driving voltage AVDD by an amount corresponding to the voltage of the pulse signal PULSE, and outputs the result of the shifting as the gate-on voltage Von. The first gate-off voltage generator 840 shifts a second input voltage Vin2, in another exemplary embodiment, which could be generated from the boost converter 810, by an amount corresponding to the voltage of the pulse signal PULSE, and outputs the result of the shifting as the first gate-off voltage Voff1. The second gate-off voltage generator 850 may receive the first gate-off voltage Voff1, divide the first gate-off voltage Voff1, and output the result of the division as the second gate-off voltage Voff2.

The structures and operations of the boost converter 810 and the temperature sensor 820 will hereinafter be described in further detail with reference to FIGS. 8 and 9.

The boost converter 810 includes an inductor L to which the first input voltage Vin1 is applied, a first diode D1 comprising an anode connected to the inductor L and a cathode connected to an output terminal of a driving voltage AVDD, a first capacitor C1 which is connected between the first diode D1 and a ground, and a pulse width modulation (PWM) signal generator 812 which is connected to the anode of the first diode D1. The boost converter 810 may be a direct current-direct current (DC-DC) converter, but the present invention is not restricted to this.

When a PWM signal output by the PWM signal generator 812 is logic high, a switching device Q2 is turned on. Then, a current $I_L$ that flows through the inductor L gradually increases in proportion to the first input voltage Vin1, which is applied to the inductor L, due to the current and voltage properties of the inductor L.

When the PWM signal is logic low, the switching device Q2 is turned off. Then, the current $I_L$ flows through the first diode D1, and the first capacitor C1 is charged due to the current and voltage properties of the inductor L. As a result, the first input voltage Vin1 is boosted, and the boosted first input voltage Vin1 is output as the driving voltage AVDD. The duty ratio of the PWM signal varies according to the temperature-variable voltage VARV. The current $I_L$ varies according to the duty ratio of the PWM signal that turns the switching device Q2 turn on or off, and as a result, the driving voltage AVDD and the pulse signal PULSE are boosted or reduced.

The operation of the PWM signal generator 812 will hereinafter be described in further detail with reference to FIG. 9. Referring to FIG. 9, an oscillator 814 generates a reference clock signal RCLK having a uniform frequency. A comparator 816 compares the voltage of the reference clock signal RCLK with the temperature-variable voltage VARV. If the temperature-variable voltage VARV is higher than the voltage of the reference clock signal RCLK, the comparator 816 outputs a PWM signal having a logic high level. On the other hand, if the temperature-variable voltage VARV is lower than the voltage of the reference clock signal RCLK, the comparator 816 outputs a PWM signal having a logic low level. In this manner, the PWM signal generator 812 generates a PWM signal.

Since the frequency of the reference clock signal RCLK is uniform, the duty ratio of a PWM signal generated by the PWM signal generator 812 varies according to the temperature-variable voltage VARV. The present invention is not restricted to the oscillator 814. In other words, the present invention can be applied to any type of circuit that can generate the reference clock RCLK whose duty ratio varies according to a control voltage signal VCONT.

The temperature sensor 820 generates the temperature-variable voltage VARV which varies according to the ambient temperature. For example, as the ambient temperature increases, the temperature-variable voltage VARV may increase. On the other hand, as the ambient temperature decreases, the temperature-variable voltage VARV may decrease. The temperature sensor 820 may include diodes D2 through D4 which have a threshold voltage that varies substantially in inverse proportion to the ambient temperature. Referring to FIG. 8, the temperature-variable voltage VARV can be obtained by passing a predetermined voltage through the diodes D2 through D4 so that the predetermined voltage drops.

As the ambient temperature increases, the threshold voltage of the diodes D2 through D4 decreases accordingly. Then, the amount by which a voltage is dropped by the diodes D2 through D4 decreases, and thus, the temperature-variable voltage VARV increases. On the other hand, as the ambient temperature decreases, the threshold voltage of the diodes D2 through D4 increases accordingly. Then, the amount by which a voltage is dropped by the diodes D2 through D4 increases, and thus, the temperature-variable voltage VARV decreases. FIG. 8 illustrates the situation when the predetermined voltage is obtained by dividing the driving voltage AVDD using resistors R1 and R2.

In other words, when the ambient temperature increases, the temperature sensor 820 provides a temperature-variable voltage VARV having a high voltage, and the boost converter 810 outputs a pulse signal PULSE and a driving voltage AVDD that having a low. On the other hand, when the ambient temperature decreases, the temperature sensor 820 provides a temperature-variable voltage VARV having a low voltage, and the boost converter 810 outputs a pulse signal PULSE and driving voltage AVDD that having a high voltage. The structures of the boost converter 810 and the temperature sensor 820 are not restricted to those illustrated in FIGS. 8 and 9.

The structures and operations of the gate-on voltage generator 830 and the first gate-off voltage generator 840 illustrated in FIG. 7 will hereinafter be described in further detail with reference to FIG. 10 on the assumption that the gate-on voltage generator 830 and the first gate-off voltage generator 840 are charge pump circuits.

Referring to FIG. 10, the gate-on voltage generator 830 includes fifth and sixth diodes D5 and D6 and second and third capacitors C2 and C3. The temperature-variable voltage VARV is provided to the anode of the fifth diode D5, and the cathode of the fifth diode D5 is connected to a first node N1. The second capacitor C2 is connected between the first node N1 and the second node N2 to which the pulse signal PULSE is applied. The anode of the sixth diode D6 is connected to the first node N1, and the cathode of the sixth diode D6 outputs the gate-on voltage Von. The third capacitor C3 is connected between the anode of the fifth diode D5 and the cathode of the sixth diode D6. The structure of the gate-on voltage generator 830 is not restricted to that illustrated in FIG. 10. In other words, the gate-on voltage generator 830 may include three or more diodes and three or more capacitors.

When the pulse signal PULSE is provided to the second capacitor C2, the first node N1 outputs a pulse that is obtained by increasing the temperature-variable voltage VARV by an amount corresponding to the voltage of the pulse signal PULSE. The sixth diode D6 and the third capacitor C3 generate the gate-on voltage Von by clamping the voltage of the first node N1, and then output the gate-on voltage Von. In other words, the gate-on voltage Von is a direct current (DC) voltage obtained by shifting the temperature-variable voltage VARV by an amount corresponding to the voltage of the pulse signal PULSE.

The gate-off voltage generator 840 includes seventh and eighth diodes D7 and D8 and fourth and fifth capacitors C4 and C5. The second input voltage Vin2 is provided to the cathode of the seventh diode D7, and the anode of the seventh diode D7 is connected to a third node N3. The fourth capacitor C4 is connected between the third node N3 and the second node N2 to which the pulse signal PULSE is applied. The cathode of the eighth diode D8 is connected to the third node N3, and the anode of the eighth diode D8 outputs the gate-off voltage Voff. The third capacitor C3 is connected between the cathode of the seventh diode D7 and the anode of the eighth diode D8. The structure of the gate-off voltage generator 840 is not restricted to that illustrated in FIG. 10. In other words, the gate-off voltage generator 840 may include three or more diodes and three or more capacitors.

When the pulse signal PULSE is provided to the fourth capacitor C4, the third node N3 outputs a pulse that is obtained by dropping the second input voltage Vin2 by an amount corresponding to the voltage of the pulse signal PULSE. The eighth diode D8 and the fifth capacitor C5 generate the first gate-off voltage Voff1 by clamping the voltage of the third node N3, and then output the first gate-off voltage Voff1. In other words, the first gate-off voltage Voff1 may be a DC voltage obtained by shifting the second input voltage Vin2 by an amount corresponding to the voltage of the pulse signal PULSE.

The temperature-variable voltage VARV and the voltage of the pulse signal PULSE vary according to the ambient temperature, as described above. Therefore, the gate-on voltage Von and the first gate-off voltage Voff1 may also vary, as illustrated in FIG. 3.

The structure and operation of the second gate-off voltage generator 850 illustrated in FIG. 7 will hereinafter be described in further detail with reference to FIG. 11. Since the first gate-off voltage Voff1 decreases at low temperatures, the second gate-off voltage generator 850 sets the amount of variation of the second gate-off voltage Voff2 with respect to temperature to be less than the amount of variation of the first gate-off voltage Voff1 with respect to temperature. Alternatively, the second gate-off voltage generator 850 may output a second gate-off voltage Voff2 which is uniform regardless of the ambient temperature. The second gate-off voltage generator 850 may include voltage dividers R3 and R4 and a Zener diode Z.

If the Zener diode Z has a breakdown voltage of −5V, the second gate-off voltage generator 850 may output a second gate-off voltage Voff2 having a uniform voltage of −5V by the resistance levels of the voltage dividers R3 and R4. When no Zener diode is provided in the second gate-off voltage generator 850, the amount of variation of the second gate-off voltage Voff2 can be set to be less than the amount of variation of the first gate-off voltage Voff1 using the voltage dividers R3 and R4.

The second gate-off voltage generator 850 may output a second gate-off voltage Voff2 that is higher than the first gate-off voltage Voff1. Since the second gate-off voltage Voff2 is used as a gate signal, it is possible to address the problem of image sticking.

Figure 12:
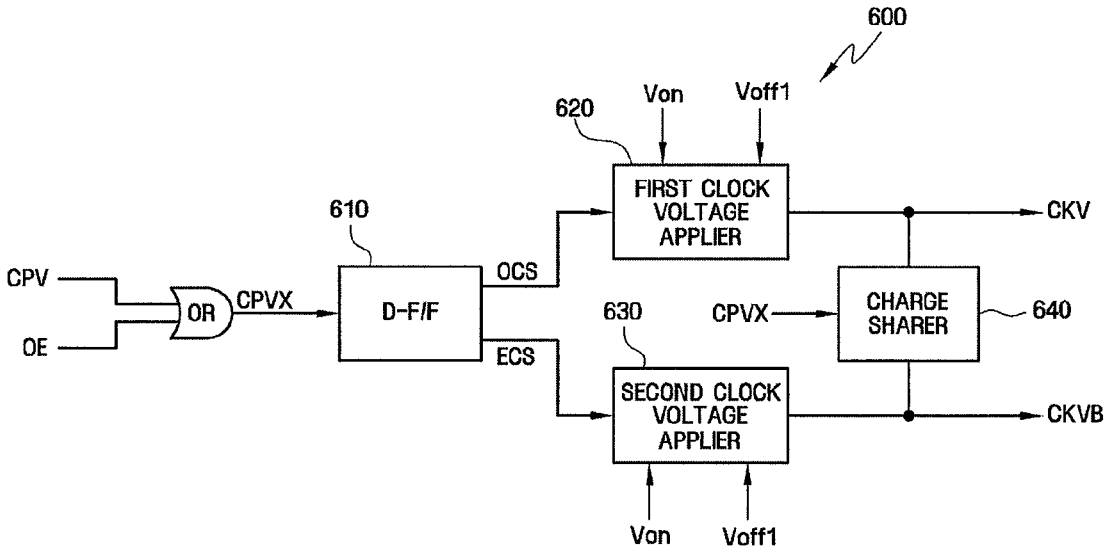
FIG. 12 is a block diagram of a clock generation unit illustrated in FIG. 1.

The structure and operation of the clock generation unit 600 illustrated in FIG. 1 will hereinafter be described in further detail with reference to FIGS. 12 through 14. FIG. 12 is a block diagram of a clock generation unit illustrated in FIG. 1, FIG. 13 is a circuit diagram of a D-flipflop illustrated in FIG. 12, and FIG. 14 is a signal diagram for explaining the operation of the clock generation unit illustrated in FIG. 12.

The clock generation unit 600 includes a logic OR operator OR, a D-flipflop 610, a first clock voltage applier 620, a second clock voltage applier 630, and a charge sharer 640. However, the clock generation unit 600 is not restricted to the structure set forth herein.

The logic OR operator OR receives a first clock generation control signal OE and a second clock generation control signal CPV, generates a third clock generation control signal CPVX performing a logic OR operation on the first clock generation control signal OE and the second clock generation control signal CPV, and provides the third clock generation control signal CPVX to the D-flipflop 610.

Figure 13:
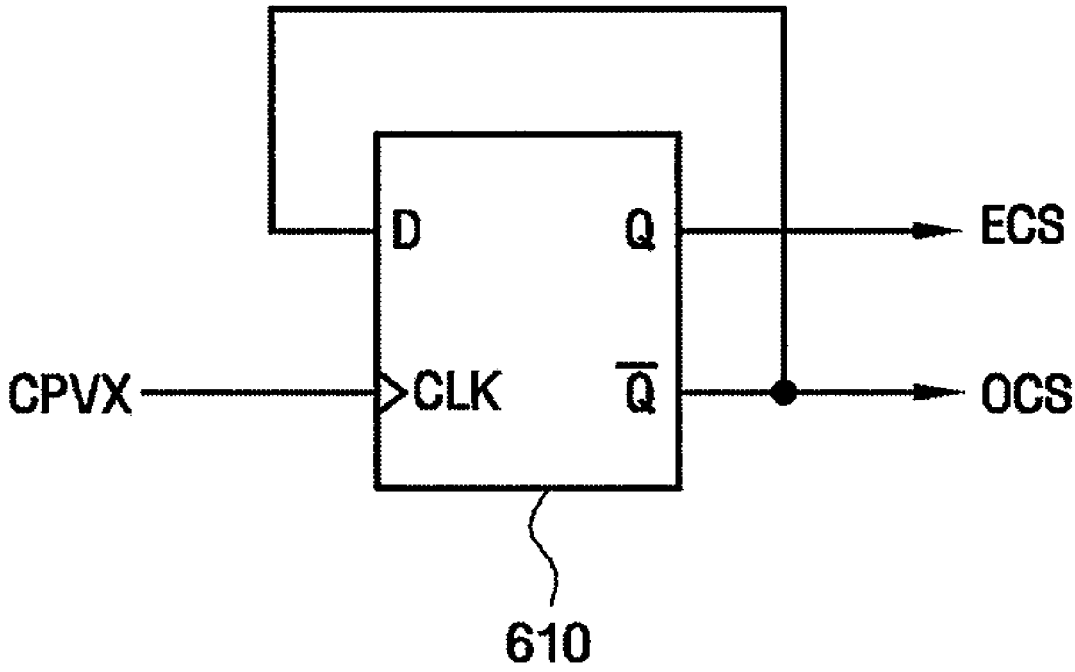
FIG. 13 is a circuit diagram of a D-flipflop illustrated in FIG. 12.
Figure 14:
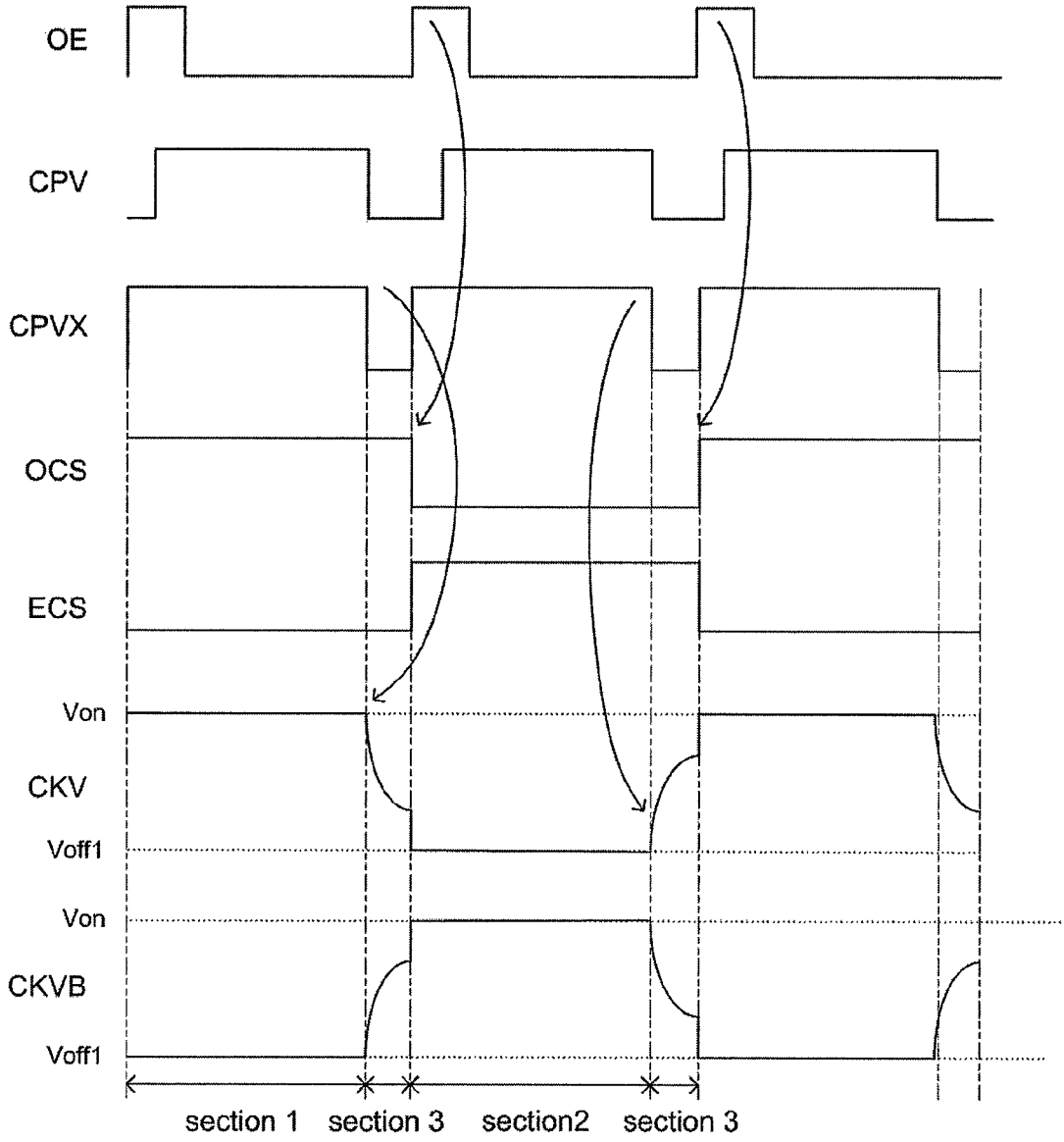
FIG. 14 is a signal diagram for explaining the operation of the clock generation unit illustrated in FIG. 12.

Referring to FIG. 13, the D-flipflop 610 receives the third clock generation control signal CPVX via the clock terminal CLK. Since an input terminal D and an output bar terminal/Q are connected, an output terminal Q outputs a second clock enable signal ECS which is toggled at each rising edge of the third clock generation control signal CPVX, and the output bar terminal/Q outputs a first clock enable signal OCS whose phase is opposite to the phase of the second clock enable signal ECS.

The first clock enable signal OCS is provided to the first clock voltage applier 620, and the second clock enable signal ECS is provided to the second clock voltage applier 630.

The first clock voltage applier 620 is enabled by the first clock enable signal OCS, and outputs the first clock signal CKV which has the gate-on voltage Von (as indicated by section 1 illustrated in FIG. 14) when the first clock enable signal OCS is logic high and which has the first gate-off voltage Voff1 when the first clock enable signal OCS is logic low (as indicated by section 2 illustrated in FIG. 14). The second clock voltage applier 630 is enabled by the second clock enable signal ECS, and outputs the second clock signal CKVB which has the gate-on voltage Von when the second clock enable signal ECS is logic high (as indicated by section 1 illustrated in FIG. 14) and which has the first gate-off voltage Voff1 when the second clock enable signal ECS is logic low (as indicated by section 2 illustrated in FIG. 14). The gate-on voltage Von and the first gate-off voltage Voff1 vary according to the ambient temperature, as illustrated in FIG. 3.

The charge sharer 640 receives the third clock generation control signal CPVX, and performs a charge sharing operation during the charge and discharge of the first clock signal CKV and the second clock signal CKVB.

Referring to FIG. 14, during section 1, the first clock signal CKV has as high a voltage as the gate-on voltage Von, and the second clock signal CKVB has as low a voltage as the gate-off voltage Voff. When the third clock generation control signal CPVX becomes logic low, the first clock signal CKV begins to be discharged, and the second clock signal CKVB begins to be charged. In other words, during section 3, the first clock signal CKV begins to be discharged while sharing charges with the second clock signal CKVB, and thus, the voltage of the first clock signal CKV gradually decreases to the gate-off voltage Voff. On the other hand, during first section 3, the second clock signal CKV begins to be charged with electric charges provided by the first clock signal CKV, and thus, the voltage of the second clock signal CKVB gradually increases to the gate on voltage Von. Since the first and second clock signals CKV and CKVB share charges during section 3, it is possible to reduce power consumption. The charge sharer 640 may not be provided if not necessary.

As described above, the LCD according to the present invention can provide the following advantages.

First, it is possible to enhance the driving capability of a gate driving unit even when the ambient temperature decreases.

Second, since a low voltage of first and second clock signals and a gate-off voltage are generated separately and are provided to gate lines, it is possible to prevent occurrence of an image retention phenomenon even when the ambient temperature decreases.

Third, it is possible to enhance display quality by enhancing the driving capability of a gate driving unit and decreasing the image retention phenomenon even when the ambient temperature decreases.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. A liquid crystal display (LCD) comprising:

a voltage generation unit which outputs a gate-on voltage and first and second gate-off voltages, the first and second gate-off voltages being different from each other;

a clock generation unit which outputs a first clock signal and a second clock signal whose phase is opposite to the phase of the first clock signal, the first clock signal swinging between the gate-on voltage and the first gate-off voltage;

a gate driving unit which is provided with the first clock signal, the second clock signal, and the second gate-off voltage and outputs a gate signal; and a display unit which comprises a plurality of pixels that are turned on or off in response to the gate signal and that display an image, wherein the voltage generation unit comprises:

a temperature sensor which outputs a temperature-variable voltage which varies according to the ambient temperature;

a boost converter which generates a driving voltage and a pulse signal by boosting a first input voltage and outputs the driving voltage and the pulse signal, the driving voltage varying according to the temperature-variable voltage;

a gate-on voltage generator which generates the gate-on voltage by shifting the driving voltage by an amount corresponding to the voltage of the pulse signal and outputs the gate-on voltage;

a first gate-off voltage generator which generates the first gate-off voltage by shifting the second input voltage by the amount corresponding to the voltage of the pulse signal and outputs the first gate-off voltage; and a second gate-off voltage generator which receives the first gate-off voltage, generates the second gate-off voltage by dividing the first gate-off voltage, and outputs the second gate-off voltage.

2. The LCD of claim 1, wherein the gate signal swings between the gate-on voltage and the second gate-off voltage.

3. The LCD of claim 2, wherein the amplitude of the gate signal decreases as the ambient temperature increases and increases as the ambient temperature decreases.

4. The LCD of claim 1, wherein the first gate-off voltage is lower than the second gate-off voltage.

5. The LCD of claim 1, wherein the gate-on voltage decreases as the ambient temperature increases and increases as the ambient temperature decreases.

6. The LCD of claim 1, wherein the temperature-variable voltage decreases as the ambient temperature increases and increases as the ambient temperature decreases.

7. The LCD of claim 6, wherein the temperature sensor comprises at least one diode which has a threshold voltage that varies substantially in inverse proportion to the ambient temperature.

8. The LCD of claim 1, wherein the second gate-off voltage generator comprises:

a voltage divider which divides the first gate-off voltage; and a Zener diode which uniformly outputs the second gate-off voltage.

9. The LCD of claim 1, wherein the first gate-off voltage increases as the ambient temperature increases and decreases as the ambient temperature decreases.

10. The LCD of claim 1, wherein the gate driving unit comprises a plurality of stages which sequentially output the gate signal, each of the stages comprising at least one amorphous silicon thin film transistor (a-Si TFT).

11. An LCD comprising:

a voltage generation unit which comprises a temperature sensor that outputs a temperature-variable voltage which varies according to the ambient temperature, a boost converter that generates a driving voltage and a pulse signal by boosting a first input voltage which varies according to the temperature-variable voltage, a gate-on voltage generator that generates the gate-on voltage by shifting the driving voltage by an amount corresponding to the voltage of the pulse signal, a first gate-off voltage generator that generates the first gate-off voltage by shifting a second input voltage by an amount corresponding to the voltage of the pulse signal, a second gate-off voltage generator that receives the first gate-off voltage, generates the second gate-off voltage by dividing the first gate-off voltage and outputs the second gate-off voltage;

a signal control unit which provides a scan start signal;

a clock generation unit which outputs a first clock signal and a second clock signal whose phase is opposite to the phase of the first clock signal, the first clock signal swinging between the gate-on voltage and the first gate-off voltage;

a gate driving unit which is enabled by the scan start signal, receives the first clock signal and the second clock signal and outputs a gate signal that swings between the gate-on voltage and the second gate-off voltage; and a display unit which comprises a plurality of pixels that are turned on or off in response to the gate signal and that display an image.

12. The LCD of claim 11, wherein the amplitude of the gate signal decreases as the ambient temperature increases and increases as the ambient temperature decreases.

13. The LCD of claim 11, wherein the temperature-variable voltage increases as the ambient temperature increases and decreases as the ambient temperature decreases.

14. The LCD of claim 11, wherein the second gate-off voltage is uniform regardless of the ambient temperature.

15. The LCD of claim 14, wherein the second gate-off voltage generator comprises:

a voltage divider which divides the first gate-off voltage; and a Zener diode which uniformly outputs the second gate-off voltage.

16. The LCD of claim 11, wherein the first gate-off voltage is lower than the second gate-off voltage.

17. The LCD of 11, wherein the gate driving unit comprises a plurality of stages which sequentially output the gate signal, each of the stages comprising:

a charge unit which is charged in response to the scanning start signal or a carry signal of a previous stage;

a pull-up unit which outputs the first clock signal or the second clock signal as the gate signal when the charge unit is charged;

a pull-down unit which pulls down the voltage of the gate signal to the second gate-off voltage in response to a gate signal of a subsequent stage; and a discharge unit which discharges the charge unit in response to the gate signal of the subsequent stage.

* * * * *